United States Patent [19]

Keyes et al.

[11] Patent Number: 4,606,842

[45] Date of Patent: Aug. 19, 1986

[54] CLEANING COMPOSITION FOR GLASS AND SIMILAR HARD SURFACES

[75] Inventors: George B. Keyes; Lux P. Requejo; Thomas B. Hilton, all of Cincinnati, Ohio

[73] Assignee: Drackett Company, Cincinnati, Ohio

[21] Appl. No.: 756,578

[22] Filed: Jul. 19, 1985

Related U.S. Application Data

[63] Continuation of Ser. No. 633,681, Jul. 25, 1984, abandoned, which is a continuation of Ser. No. 355,218, Mar. 5, 1982, abandoned.

[51] Int. Cl.[4] ..... C11D 3/37

[52] U.S. Cl. ..... 252/174.23; 252/89.1; 252/158; 252/162; 252/173; 252/174.16; 252/556; 252/DIG. 2; 252/DIG. 10; 252/DIG. 11; 134/40

[58] Field of Search ..... 252/174.24, 174.23, 252/174.17, 174.18, DIG. 10, DIG. 2, 556, 158, 180

[56] References Cited

U.S. PATENT DOCUMENTS

| | | | |
|---|---|---|---|
| 2,292,097 | 8/1942 | Vollmer | 106/13 |
| 2,313,425 | 3/1943 | Flaxman | 252/139 |
| 2,524,380 | 10/1950 | Flaxman | 252/139 |
| 3,212,909 | 10/1965 | Leigh | 106/13 |
| 3,245,912 | 4/1966 | White | 252/70 |
| 3,342,740 | 9/1967 | Kazmierczak et al. | 252/153 |
| 3,387,024 | 6/1968 | Quimby | 260/502.4 P |
| 3,463,735 | 8/1969 | Stonebraker | 252/152 |
| 3,485,762 | 12/1969 | Gower | 252/152 |
| 3,686,145 | 8/1972 | Haschke et al. | 252/174.24 |
| 3,696,043 | 10/1972 | Labarge | 252/153 |
| 3,706,672 | 12/1972 | Martin et al. | 252/534 |
| 3,719,647 | 3/1973 | Hardy et al. | 252/112 |
| 3,825,498 | 7/1974 | Altenschopfer | 252/99 |
| 3,839,234 | 10/1974 | Roscoe | 252/544 |
| 3,922,230 | 11/1975 | Lamberti et al. | 252/89 |
| 3,923,678 | 12/1975 | Kleiner et al. | 252/89 |
| 3,939,090 | 2/1976 | Zmoda | 252/DIG. 10 |
| 3,940,356 | 2/1976 | Byrnes | 524/388 |
| 3,950,260 | 4/1976 | Eldib | 252/89 |
| 3,965,024 | 6/1976 | Schmadel et al. | 252/95 |
| 3,969,500 | 7/1976 | Kennerley | 252/554 |
| 4,021,376 | 5/1977 | Lamberti et al. | 252/542 |
| 4,086,178 | 4/1978 | Walker | 252/DIG. 10 |
| 4,203,858 | 5/1980 | Chakrabarti | 252/99 |
| 4,204,052 | 5/1980 | Crutchfield et al. | 252/174.24 |
| 4,213,873 | 7/1980 | Church | 252/174.21 |
| 4,247,408 | 1/1981 | Imamura et al. | 252/143 |
| 4,302,348 | 11/1981 | Requejo | 252/135 |
| 4,302,364 | 11/1981 | Gosset et al. | 252/545 |

FOREIGN PATENT DOCUMENTS

| | | |
|---|---|---|
| 0772373 | 1/1972 | Belgium . |
| 1467656 | 2/1973 | Fed. Rep. of Germany . |
| 451342 | 7/1936 | United Kingdom . |
| 1542027 | 3/1979 | United Kingdom . |

OTHER PUBLICATIONS

Rohm and Haas Co., "A New Series of Low Molecular Weight (MW 1000–4500) Polyacrylic Acids and Sodium Salts–Detergent Additives", (Nov. 1981).

Rohm and Haas Co., "Polyacrylic Acids Acrysol A-1, A-3 and A-5", (Feb. 1968).

Rohm and Haas Co., "Experimental Resin QR-784, A New Detergent Builder", DIC 79-7 (Jun. 1979).

Technical Bulletin, Colloid 119/50, Antiscalant Colloid, Inc., May 1979.

Polymeric Additives for Aqueous Systems, Rohm & Haas Company, Dec. 1981.

Product Data Bulletin, Calnox 214, Aquaness Chemical.

Polymeric Additives for Aqueous Systems, Rohm & Haas Co., Dec. 1981.

Technical Bulletin, Colloid 117, Colloids, Inc., Apr. 1978.

*Primary Examiner*—Paul Lieberman
*Assistant Examiner*—Hoa Van Le
*Attorney, Agent, or Firm*—Charles J. Zeller

[57] ABSTRACT

A polyacrylic resin which can be a polyacrylic acid or a mixture of a polyacrylic acid and an acrylic polymeric complex with a phosphinate or sulfur containing moiety is used as a builder in an aqueous glass cleaning composition of the spray-on wipe-off type containing an organic solvent system and at least one detergent surface active agent. Cleaning efficiency is comparable to and even superior to tetrasodium pyrophosphate built compositions.

29 Claims, No Drawings

CLEANING COMPOSITION FOR GLASS AND SIMILAR HARD SURFACES

This application is a continuation of application Ser. No. 633,681, filed July 25, 1984, now abandoned, which in turn is a continuation of Ser. No. 355,218, filed Mar. 5, 1982, now abandoned.

BACKGROUND OF THE INVENTION

1. Field of the Invention

This invention relates to an improved glass or similar hard surface cleaning composition. More particularly, this invention relates to an aqueous hard surface cleaning composition, especially glass surfaces, of the general type disclosed in the Stonebraker, et al U.S. Pat. No. 3,463,735 in which a low molecular weight polyacrylic acid composition replaces the alkali metal polyphosphate builder component to provide improved cleaning capacity.

2. Discussion of the Prior Art

U.S. Pat. No. 3,464,735 to Stonebraker, et al discloses a glass cleaning composition of the type containing a solvent system consisting of a mixture of low boiling solvent and moderately higher boiling solvent and a surfactant, and preferably ammonia, in which the effectiveness of the glass cleaning composition is improved by incorporating therein an alkali metal polyphosphate, especially tetrasodium pyrophosphate. In fact, since the Stonebraker patent issued in 1969, the polyphosphate built compositions have consistently provided the most superior performance of all commercially available hard surface aqueous cleaning compositions with regard to such properties as fat and grease removal, wipe-off characteristics, and the like. Attempts to replace the alkali metal polyphosphate builders with alternative builders have met with only marginal success in view of the superior overall performance of the polyphosphate built compositions, as well as the cost benefits of the polyphosphates as compared to alternative builders.

In general, the practitioner in this field does not expect to find alternative builders for the alkali metal polyphosphates which can give equivalent enhancement of the cleaning capabilities of detergent compositions when used at the same weights, much less at lower weights, of the alternative builder.

For instance, in U.S. Pat. No. 3,706,672—Martin, et al an essentially phosphate-free detergent washing composition in which an organic alkaline builder-sequestrant selected from relatively high molecular weight alkali metal, ammonium or substituted ammonium polyacrylates having an inherent viscosity, in 2 normal sodium hydroxide in the range of about 0.05 to about 1.25, is provided. The reader is also referred to the prior art patents and literature referred to in columns 1 and 2 of the patent for other disclosures relating to acrylic acid polymers, copolymers and salts thereof as detergent builders.

U.S. Pat. No. 3,922,230—Lamberti et al discloses oligomeric polyacrylate biodegradable detergent builders useful in detergent compositions comprising said polyacrylate, which has a molecular weight between about 500 and 10,000, and a surfactant, the polyacrylate having biodegradable terminal groups selected from the group consisting of sulfur and hydroxy containing moieties. The ratio of builder to surfactant is in the weight ratio of 1:20 to 20:1.

Other U.S. patents broadly relating to acrylic acid polymers and copolymers or derivatives thereof for use in detergent compositions include the following: U.S. Pat. Nos. 3,719,647—Hardy, et al; 3,825,498—Altenschopfer, et al; 3,950,260—Eldib; 3,969,500—Kennerley; and 4,021,376—Lamberti, et al. U.S. Pat. No. 3,965,024 to Schmadel, et al discloses washing agent compositions and washing assistant compositions which contain from 0.5% to 70% by weight of a phosphonopolycarboxylate monomer.

However, none of these prior art compositions suggest the use of a low molecular weight polyacrylic acid, a salt thereof, and/or an acrylic acid polymeric resin complex containing inorganic phosphate or sulfur moieties for incorporation in glass cleaning compositions or similar hard surface cleaning compositions of the type disclosed by Stonebraker in the aforementioned U.S. Pat. No. 3,463,735.

A cleaning composition for glass and similar hard surfces similar to that of Stonebraker is disclosed by Labarge, et al in U.S. Pat. No. 3,696,043. This patent is based upon the incorporation of a water soluble polymeric salt which is a copolymer of one to two moles of a monovinyl aromatic monomer per mole of an unsaturated dicarboxylic acid or an anhydride thereof wherein the acid is neutralized with a sufficient amount of an amine, ammonia or an alkali metal base to form a solubilizing salt group or wherein the anhydride is neutralized by a sufficient amount of ammonia or a monoamine having no other groups reactive with the anhydride group to form a solubilizing salt group. The glass cleaning compositions of Stonebraker, et al and Labarge, et al are characterized by, and can be distinguished from, the light duty and heavy duty detergent compositions of the aforementioned patents such as the Hardy, et al patent, by the presence of an organic solvent system, especially an alcohol-glycol solvent system, among others. Moreover, the glass cleaning compositions to which the present invention is primarily concerned, can be functionally distinguished from the light duty dishwashing compositions and heavy duty laundry compositions as having a much lower level of active constituents and by the higher operating temperatures and foaming characteristics of the latter. In particular, the glass cleaning compositions and similar hard surface cleaning compositions to which the present invention is concerned, are applied directly to the surface to be cleaned at ambient room temperature, usually by pump or aerosol type spray applicators.

SUMMARY OF THE INVENTION

Surprisingly, it has now been found that low molecular weight polyacrylic resins not only can replace the conventional alkali metal polyphosphate builders incorporated in glass cleaning compositions, but, in fact, can provide superior cleaning effectiveness to even tetrasodium pyrophosphate (TSPP) built compositions, TSPP being the preferred material of Stonebraker, et al and the most common of the commercially used polyphosphate builders in glass cleaning compositions, when used at the same weight levels.

Accordingly, in its broadest aspect, the present invention provides an aqueous liquid glass or similar hard surface cleaner composition of the type which includes at least one organic solvent, at least one compatible anionic and/or non-ionic surface active agent, optionally, but preferably, ammonia, optionally, but preferably, a fluorocarbon surfactant, and a polyacrylic resin having a weight average molecular weight from about 500 to about 8000.

The present invention provides aqueous compositions for cleaning glass and similar hard surfaces comprising an aqueous solution of (a) about 0.5–8% of at least one lower aliphatic monohydric alcohol having about 2–4 carbon atoms and a boiling point not in excess of about 100° C.;

(b) about 0.5–5% of at least one higher boiling polar organic solvent selected from the group consisting of glycols having from 2–6 carbon atoms and 1–4 carbon alkyl ethers of a glycol containing a total of about 3–8 carbon atoms, said polar organic solvent having a boiling point not in excess of about 250° C.;

(c) about 0.05%–5% of at least one surface active agent compatible with components (a) and (b) and selected from the group consisting of water soluble anionic and non-ionic surface active agents;

(d) about 0.005 to about 2.0% of a low molecular weight polyacrylic resin, which can be a polyacrylic acid or salt thereof, or which can be a mixture of said polyacrylic acid or acid salt and a polymeric acrylic acid complex, for example a complex containing a phosphinate moiety, said complex being characterized by the formula $$(C_3H_4O_2.H_3O_2P.M)_y$$

where the M's are independently a hydrogen atom or a member selected from the group consisting of alkali metal, ammonium ion, and amino group, and y is a number of from about 5 to about 60;

(e) 0 to about 0.5% of a non-ionic or anionic fluorinated hydrocarbon surfactant, particularly a perfluorooxybenzene sulfonic acid salt or a linear perfluoroalkyloxybenzoic acid, and (f) 0 to about 2.5% of a fugitive alkaline compound, especially ammonia.

In another aspect of the invention, the composition is provided as a concentrate, the water concentration thereof being at least about 50% by weight, said concentrate being diluted prior to use to provide the glass cleaning composition of the previous paragraph.

In addition to the above mentioned constituents (a) to (f), the hard surface cleaning composition of the present invention may optionally include a monoalkanolamide surfactant. It has been found that the polyacrylic polymers used herein are compatible with the alkali metal polyphosphates used previously as detergent builders, and same may be incorporated in the formulation of the present invention if desired. Aerosols of the present composition can be made by the inclusion of a suitable propellant, for example, propane, butane, or a fluorocarbon. When in the aerosol form, an oxidizer such as sodium nitrite, sodium nitrate, and the like is included as a corrosion inhibitor.

DETAILED DESCRIPTION OF THE INVENTION

As previously noted, the hard surface cleaning compositions of the present invention are improvements of the glass cleaning compositions of the aforementioned Stonebraker, et al and Labarge, et al patents wherein the alkali metal polyphosphate of Stonebraker, et al and the polymeric salt of Labarge, et al are replaced by a specific class of a polyacrylic resin builder-sequestrant agent for enhancing the cleaning efficiency of the compositions when used at equivalent active weights, beyond the general expectations of the ordinary practitioner. For convenience the disclosures of the Stonebraker, et al. U.S. Pat. No. 3,463,735 and Labarge, et al. U.S. Pat. No. 3,696,043 are incorporated herein in their entireties by reference thereto.

The basic components of the glass cleaning compositions include in addition to water, which is the main ingredient, an organic solvent system, compatible surfactant or surfactants, and the polyacrylic resin. Preferably, an organic fluorocarbon surfactant for lowering surface tension and a fugitive alkaline substance, such as ammonia, for enhancing the cleaning capability of the composition are included in the compositions. Additionally, such other conventional ingredients as perfumes, antifog agents, foaming agents, chelating agents, other inorganic builders, propellants, and the like, in amounts which do not adversely affect the cleaning and other beneficial properties of the invention compositions, can be used within the scope of the invention.

The improved cleaning efficiencies of the compositions of the present invention have been measured with several criteria including cleaning of grease films, cleaning of aged grease films and cleaning more difficult to remove than grease soils such as pigmented test soils. Against all of these criteria, the formulations according to the present invention containing the polyacrylic resin proved equal to or superior to otherwise identical compositions but containing an alkali metal polyphosphate in place of the polyacrylic resin. These test procedures are similar to those described in the Stonebraker, et al patent but also include more discriminating tests as will be described in the examples given below.

The polyacrylic resin used in the present invention is a low molecular weight polyacrylic acid having the following formula:

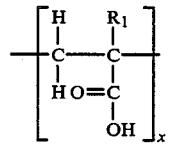

where x is a number of from about 10 to about 100, the weight average molecular weight being between about 500 to about 8000. The end groups are not considered to be critical, and vary according to manufacturer and the method of preparation; $R_1$ is hydrogen or methyl. Typically, the end groups are hydrocarbon chains of from one to six carbons containing one or more carboxylic acid groups, which groups may be neutralized to an alkali, ammonium or amino salt.

It is not necessary that the polyacrylic resin used herein be a homopolymer of the acrylic repeating unit. For example, an acrylic acid polymeric complex of the type

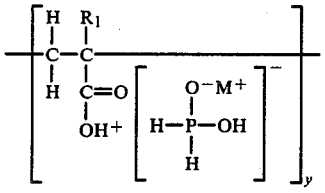

wherein $R_1$ is as previously described, y is a number from about 5 to about 60, and the M's are independently hydrogen or a member selected from the group consisting of alkali metal, ammonium or amino cations, admixed with the homopolymer has provided excellent results as the polyacrylic resin detergent builder. A particular polymeric complex of this type is identified as 2-propenoic acid, complexed with sodium phosphinate by the Chemical Abstract Services Registry, CAS No. 71050-62-9, which indicates the chemical formula as being $(C_3H_4O_2.H_3O_2P.Na)_y$. Polyacrylic complexes of this type also may include moieties containing sulfur and other moieties in lieu of the phosphinate moiety. The polyacrylic resin is generally provided in the composition at a weight ratio of the polyacrylic acid to the complex of from about 1:1 to about 15:1, preferably from about 3:1 to about 10:1.

After preparation of the acid form (M=H) of the polyacrylic resin, hydroxyl groups of the terminal acid groups may be partly or essentially completely neutralized with alkali metal, ammonium, or amino cations. The alkali metal may be lithium, potassium or sodium, preferably sodium. In practice, generally from about 20 to about 80% of these acid groups are in the acid form, the remaining acid groups having one hydrogen atom of one of the hydroxyl groups replaced by the alkali metal, ammonium ion or amino group, preferably the ammonium ion or sodium metal.

The preferred value for x is in the range of from about 15 to about 70, while the preferred value for y is in the range of from about 20 to about 50. The polymerization reactants can be any of those which are normally used for forming polyacrylic acid polymers such as shown, for example, in any of the aforementioned patents disclosing such polyacrylic acid resin polymers, copolymers, complexes, and derivatives thereof.

The polyacrylic resin can conveniently be provided in the form of its aqueous solution, generally at about 40 to about 60% by weight solids level. When the polyacrylic resin is provided in this form, it is generally characterized by having a Brookfield viscosity in the range of from about 100 to about 1500 cps at 25° C., preferably from about 400 to about 850 cps at 25° C. The resin has a pH range of from about 1.5 to about 9.0, depending upon the degree of neutralization, with an acid value of from about 2 to about 30, preferably from about 5 to about 20, milliequivalents per gram of polyacrylic resin calculated on a 100% active basis. The polyacrylic resins used herein have a molecular weight distribution wherein the weight average molecular weight $\overline{M}w$ is from about 500 to about 8000, preferably from aout 1000 to about 5000, the number average molecular weight $\overline{M}n$ is about 600 to about 4000, preferably from about 1200 to about 3000. The ratio $\overline{M}w/\overline{M}n$ is from about 0.2 to about 2.7.

The polyacrylic resin is present in the compositions in amounts from about 0.005 to about 2.0% by weight, preferably from about 0.01 to about 0.50% by weight, on an active basis.

Specific polyacrylic resins which have been found to provide excellent results when incorporated into the cleaning composition of the present invention are resins sold by Rohm and Haas Company under the trademark Acrysol LMW, for example Acrysol LMW-45X, a polyacrylic acid resin containing no phosphates having a molecular weight $\overline{M}w$ of about 4500, a viscosity of about 600 cps, and a pH of about 1.5, Acrysol LMW-20X, a partially neutralized sodium salt polyacrylic resin having a molecular weight $\overline{M}w$ of about 2000, a viscosity of about 600 cps, and a pH of abut 3.8, and Acrysol LMW-20NX, a polyacrylic acid sodium salt having a molecular weight $\overline{M}w$ of about 2000, a viscosity of about 300 cps, and a pH of about 9.1; a resin sold by Colloids, Inc. under the tradename Colloid 119/50, which has a molecular weight of about 1200, a viscosity of about 125 cps, and a pH of about 2.1, and resins sold under the trademark Calnox by Aquaness Chemicals, Inc., for example Calnox 214, having a viscosity of about 16–24 cps (Hoeppler at 77° F.) and a pH of 4.7–5.3, and which is at least 70% neutralized to the sodium salt, and phosphate free Calnox 236, having a molecular weight of about 5000, a viscosity of about 320 cps (Hoeppler at 77° F.), and a pH of about 2.0 (10% solution).

The organic solvent which has proven to be particularly useful for the glass cleaning compositions of this invention is based on a mixture of at least one lower alkylene or polyalkylene glycol or lower alkyl ether thereof, of moderately higher boiling point than the aliphatic alcohol. The preferred lower aliphatic alcohols are those containing from two to four carbon atoms and having a boiling point lower than about 100° C., preferably from about 75° to about 100° C. Examples of suitable alcohol components include, for example, isopropyl alcohol, n-propyl alcohol, ethyl alcohol, sec-butyl alcohol and tert-butyl alcohol. Isopropyl alcohol is preferred. A suitable amount of the lower alcohol is about 0.5–8% by weight, preferably about 1 to about 5% by weight, based on the total composition. Two or more of the alcohol compounds can be combined, if desired.

As the higher boiling polar organic solvent, glycols having from 2–6 carbon atoms and the alkyl ethers thereof are conveniently used. Preferably the higher boiling solvent is selected from alkylene and polyalkylene glycols containing about 2–6 carbon atoms and the $C_{1-4}$ lower alkyl ethers thereof containing a total of about 3–8 carbon atoms. The boiling point of the polar organic solvent should be less than about 250° C. Suitable higher boiling solvents include, for example, ethylene glycol, propylene glycol, trimethylene glycol, 1,2-butanediol, 1,3-butanediol, tetramethylene glycol, 1,2-pentanediol, 1,4-pentanediol, pentamethylene glycol, 2,3-hexanediol, hexamethylene glycol, glycol monoethyl ether, glycol monobutyl ether, glycol momomethyl ether, propylene glycol monoethyl ether, and diethylene glycol monoethyl ether. Particularly good results, especially in combination with isopropyl alcohol, are provided by the glycol monobutyl ether and propylene glycol monomethyl ether. The amount of the higher boiling component is generally in the range of from about 0.5 to about 5% by weight, preferably about 1 to about 3% by weight, based on the total composition. Mixtures of two or more of the higher boiling compounds may be employed within these weight ranges. The total amount of the organic solvent system is not particularly critical but generally it is preferred that the total amount of the alcohol (a) and polar organic solvent (b) be within the range of from about 2 to about 10% by weight, preferably from about 3 to about 7.5% by weight, with a weight ratio of (a) to (b) being in the range of from about 5:1 to 1:1, preferably 4:1 to 2:1.

Virtually any compatible surface active agent which does not react with the organic solvent system or other components of the aqueous compositions can be used in the present invention. The preferred surface active agents are the water soluble anionic and non-ionic surface active agents which can be selected from among any of the known materials in these categories. Typical anionic and non-ionic surfactants are described, for example, in the aforementioned patents to Stonebraker, et al and Labarge, et al, as well as the other patents mentioned above. Typical examples of the anionic surfactants include the sulfonated fatty alcohols containing from about 8–18 carbon atoms or more, sulfated fatty oils or esters, sulfated polyethylene oxides ethers or fatty alcohols, and alkyl aryl sulfonates, which are present in the form of the alkali metal salts thereof, especially the sodium or potassium salts thereof, most expecially the sodium salts. The preferred anionic surfactants are the alkali metal fatty sulfates, especially sodium lauryl sulfate.

Examples of the non-ionic surfactant include, for example, the polyethylene oxide ethers of fatty alcohols and polyoxyethylene ethers of alkyl phenols, the latter being especially preferred.

Generally, the surface active agent is present in amounts of from about 0.05 to about 5% by weight of the total composition. The surface active agents can be used as mixtures, and, in fact, mixtures of the water soluble anionic surface active agent with small amounts of the non-ionic surface active agent have been found to be especially preferred. The preferred amount of the surface active agent or mixtures thereof is in the range of from about 0.05 to about 1% by weight, based on the total composition.

It is also preferred to incorporate small amounts of a fugitive alkaline agent such as 26° Baumë ammonia in the aqueous cleaning compositions of the invention. The ammonia is generally added as ammonium hydroxide. Other volatile alkaline materials such as alkanol amines, morpholine, and the like can also be used. Suitable amounts of the fugitive alkaline agent are in the range of from aobut 0.005–2.5%, preferably about 0.015–0.8%, by weight based on the total composition and calculated as ammonia ($NH_3$). The ammonia or other fugitive alkaline agent can be added in amounts sufficient to provide aqueous compositions having a pH in the range of from about 9.5–13, preferably about 10–12.5.

It has also been discovered in accordance with the present invention that the effectiveness of the aqueous glass cleaning compositions of this invention can be even further enhanced by incorporating a small amount of an organofluorocarbon surfactant in active amounts within the range of from about 0.005–0.5% by weight, preferably from about 0.01–0.5% by weight, based on the total composition. The preferred fluorocarbon surfactants include the perfluoroaliphaticoxybenzene sulfonic acid anionic salts and the anionic salts of linear perfluoroalkyl oxybenzoic acids. Examples of the former class of fluorocarbon surfactants can be represented by the following formula:

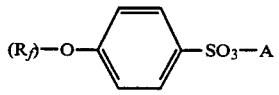

where $R_f$ is a perfluoroaliphatic group of from about 5 to about 15 carbon atoms, preferably from about 8 to 12 carbon atoms in the aliphatic group which may be an alkyl group or alkenyl group, and A is an cation such as an alkali metal, ammonium or amine.

Examples of the latter class of fluorocarbon surfactants can be represented by the formula:

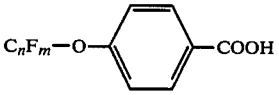

wherein n is a number of from about 2 to about 16 and m is a number from about 3 to about 34.

Especially preferred results have been obtained with 4-[[4,4,5,5,5-pentafluoro-3-(pentafluoroethyl)-1,2,3-tris(trifluoromethyl)-1-pentenyl]oxy]-benzene-sulfonate, sodium salt, sold under the trademark Monflor 31 by ICI Americas, Inc. and with a particular linear perfluoroalkyloxybenzoic acid sold under the trademark Surflon S-113, also manufactured by ICI Americas, Inc. U.S. Pat. No. 4,302,348 to Requejo describing these and other fluorinated surfactants suitable for the present composition is incorporated herein by reference thereto.

The composition may, of course, include other conventional adjuvants commonly used in hard surface cleaning compositions, for example, other inorganic builders in small amounts, such as borax, sodium polyphosphates, and the like; foaming or anti-fog agents, such as the various orgnosiloxane-oxyalkylene compounds and polysiloxanes; perfumes; dyes, and the like. Generally, the amount of the additional inorganic builders, if added, should be below about 0.5% by weight, preferably less than about 0.05% by weight. Amounts of the anti-fog agents are generally less than about 5% by weight, especially less than about 2% by weight, especially preferably less than about 0.5% by weight. Amounts of dyes and perfumes up to about 0.2% by weight, preferably up to about 0.1% by weight can also be included in the compositions.

The glass cleaning composition described above may also be obtained by dilution of a concentrate prior to use, the concentrate containing no more than 50% actives by weight. In a particular formulation, the concentrate contains up to about 30%, preferably 15 to 25%, by weight of the lower aliphatic alcohol solvent, up to about 12%, preferably between 6 to 10%, by weight of the higher boiling solvent, less than about 2% by weight of the polyacrylic resin, and between about 0.5 to about 5% by weight of the surfactant. Optional constituents, for example, the fluorosurfactant and the fugitive alkaline agent can be incorporated at suitable levels. The ability to formulate a concentrate is a particular advantage over Stonebraker et al, inasmuch as there is no incompatibility between the builder and the higher solvent concentration.

In aerosol formulas, in addition to the propellant, for example propane, butane, or a fluorocarbon, it is preferred to include a corrosion inhibitor, for example sodium nitrite or sodium nitrate, and a foaming agent identified above. The corrosion inhibitor is typically incorporated at a level of about less than 1.0% by weight, preferably less than about 0.5% by weight.

The formulations may be applied simply as a solution by wiping it on the surface to be cleaned, or the container may also have an atomizer attachment for spraying on the surface.

In addition to the ingredients named above, it is of course apparent that the main ingredient of the compositions of the invention is water and preferably soft water containing not substantially more than about 1 grain hardness per gallon.

EXAMPLE 1

The following compositions are prepared:

| | Percent by Weight (Actives) | | | | | |
|---|---|---|---|---|---|---|
| | This invention | | Comparisons | | | |
| Ingredients | A | B | C | D | E | F |
| Isopropyl Alcohol | 4.0 | 4.0 | 4.0 | 4.0 | 4.0 | 4.0 |
| n-Butyl monoether ethylene glycol | 2.5 | 2.5 | 2.5 | 2.5 | 2.5 | 2.5 |
| Sodium lauryl sulfate | 0.1 | 0.1 | 0.1 | 0.1 | | 0.1 |
| Polyacrylic Resin* | 0.01 | 0.01 | | | | |
| Fluorocarbon Surfactant** | | 0.02 | 0.02 | | 0.02 | |
| Tetrasodium Pyrophosphate | | | | | | 0.01 |
| Ammonium Hydroxide | 0.6 | 0.6 | 0.6 | 0.6 | 0.6 | 0.6 |
| Deionized Water | qs 100 | qs 100 | qs 100 | qs 100 | qs 100 | qs 100 |

*an aqueous solution, approximately 50% by weight actives, of a polyacrylic resin comprising a mixture of polyacrylic acid having the formula

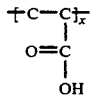

where x averages about 70 and an acrylic acid complex of the formula

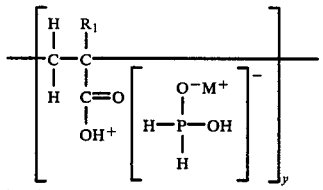

wherein y is about 50–55, and M is either hydrogen or sodium, about 80% of the total resin being in the acid form. This product is further characterized by a ratio of polyacrylic acid to the polymeric acrylic acid complex of about 4:1, a specific gravity of about 1.18 g/ml, and a pH of about 2.5. The weight average molecular weight by gel permeation chromatography is about 6000. Brookfield viscosity is between about 150 to 350 cps at 22° C. The polymeric complex is of the type defined by CAS No. 71050-62-9.

**Monflor 31, a product of ICI Americas, Inc. - 30% by weight solution in a mixed isopropyl alcohol/water solvent of 4-[[4,4,5,5,5-pentafluoro-3-(pentafluoroethyl)-1,2,3-tris(trifluoromethyl)-1-pentenyl]oxy]-benzene sulfonate, sodium salt.

EXAMPLE 2

This example shows the results which are obtained when the compositions A, C, D and F from example 1 are used in a static fat-grease film removal test. The fat-grease film is prepared as described in U.S. Pat. No. 3,463,735—a 1% solution of beef fat in hexane is sprayed on a microscope slide and allowed to dry for 90 minutes, after which the slide is wiped gently several times with paper toweling to remove excess fat and leave a thin uniform grease film on the surface of the slide. A drop of the cleaning solution is then placed on the surface of the slide bearing the film and allowed to remain in contact with the film for five (5) seconds. The results are shown in the following table:

| Fresh Grease Plate - Grease Removal Test<br>Contact Time: 5 seconds | |
|---|---|
| Composition | % Grease Removal |
| A | 100 |
| C | 55 |
| D | 18 |
| F | 100 |

The percent grease removal is mesured qualitatively by visual inspection, each composition being tested a number of times to ensure reproducibility of the test. Compositions A and F both removed approximately all grease from the slide. The data indicates that the formulation of the present invention is at least as effective as the formulation F containing the heretofore preferred builder, TSPP. Accuracy of about 5% is achieved with the procedure.

EXAMPLE 3

This example shows the results which are obtained with the compositions of example 1 in removing a fat-grease film prepared as in example 1 except that the film is allowed to age overnight (about 24 hours and the compositions are allowed to remain in contact with the aged film for 15 seconds. The results are shown in the following table:

| Aged Grease Plate - Grease Removal Test<br>Contact Time: 15 seconds | |
|---|---|
| Composition | % Grease Removal |
| A | 99 |
| B | 100 |
| C | 51 |
| D | 39 |
| E | 14 |

-continued

| Aged Grease Plate - Grease Removal Test Contact Time: 15 seconds | |
|---|---|
| Composition | % Grease Removal |
| F | 100 |

These results show that the fluorochemical surfactant by itself (Composition E) offers very little detersive properties on grease. When sodium lauryl sulfate is combined with the fluorosurfactant (Composition C), the attack on the grease film improves. However, the results using sodium lauryl sulfate without a builder and without the fluorosurfactant (Composition D) and with the fluorosurfactant (Composition C) are about the same.

The polyacrylic resin built compositions of this invention—Compositions A and B—have comparable cleaning ability in the grease film removal test for removing the relatively fresh grease film as well as the more difficult to remove aged grease film as compared to the phosphate built glass cleaning composition (Composition F).

The fresh grease film and aged grease film plate cleaning tests of examples 1 and 2 are adequate to distinguish the lesser cleaning capacity formulas (Compositions C, D and E) from those having greater capacity (A, B and F). Moreover, these tests show that merely wetting a surface, or soil, is not enough to achieve effective cleaning but the presence of at least one ingredient having detersive properties, e.g. sodium lauryl sulfate, is also necessary (compare Compositions C and E).

In order to further compare the effectiveness of the polyacrylic resin built compositions to the phosphate built compositions, the procedure of the aged grease film removal test is repeated except that the contact time between the cleaning compositions and the aged grease film is reduced to only 5 seconds. The results are shown in the following table:

| Aged Grease Plate - Grease Removal Test Contact Time: 5 seconds | |
|---|---|
| Composition | % Grease Removal |
| A | 78 |
| B | 72 |
| C | 30 |
| D | 20 |
| E | 20 |
| F | 63 |
| G | 80 |

Composition G has the same formula as Composition B except that the amount of the polyacrylic resin is increased from 0.01 active weight % to 0.1 active weight %.

From these results, it can be appreciated that the compositions containing the polyacrylic resin builder alone (Composition A) or both the polyacrylic resin and fluorocarbon surfactant (Composition A, B and G) provide greater cleaning capacity than a similar composition containing an equivalent amount of a phosphate builder (Composition F). Moreover, it is again observed that compositions which do not include any builder, but do include sodium lauryl sulfate (Composition D) or which contain only the fluorosurfactant, without the sodium lauryl sulfate (Composition E) are least efficient and only a moderate improvement in the grease removal capacity is provided by combining the fluorosurfactant and sodium lauryl sulfate (Composition C).

EXAMPLE 4

In this example Compositions A, B, C, and D from example 1 are evaluated in their ability to clean a different type of soil from a glass substrate. In this test procedure a film of a waxy China marker is applied to a glass plate and the plate immersed in the test cleaning composition for 30 seconds. The treated film is then scrubbed using 25 scrub cycles on a Gardner Washability and Abrasion machine using a cellulose sponge as the scrubbing medium. An array of nine test plates for each composition is cleaned in accordance with this procedure. The arrays of cleaned plates are then evaluated by a panel of evaluators (at least 10 in number) who select the cleanest plates in a side-by-side blind comparison. Side bias is minimized by rotation of the plates. The results are shown in the following table:

| Run No. | Compositions | Cleanest Panel, % Preference* |
|---|---|---|
| 1 | C | 60 |
| | vs | |
| | D | 19 |
| 2 | D | 14 |
| | vs | |
| | A | 74 |
| 3 | A | 26 |
| | vs | |
| | B | 58 |
| 4 | A | 77 |
| | vs | |
| | C | 15 |

*The difference between 100% and the combined indicated percentages represents % ties.

EXAMPLE 5

In this example, the polyacrylic resin built composition A from example 1 is compared to similar compositions except that an equivalent amount (0.01% by weight) of other typical builders is used in place of the polyacrylic resin in the waxy China marker soil removal test. The results are shown below:

| Run No. | Builder | % Preference Cleanest Panel* Variable vs. Control |
|---|---|---|
| 1 | Polyacrylic resin (Composition A) | Control (this invention) |
| 2 | Sodium Carbonate | 23% vs 74% |
| 3 | Sodium Metasilicate | 8% vs 90% |
| 4 | Sodium Borate | 10% vs 87% |
| 5 | Ammonium Carbonate | 37% vs 60% |
| 6 | Ammonium Bicarbonate | 23% vs 69% |
| 7 | Sodium Citrate | 42% vs 51% |
| 8 | Builder M** | 31% vs 62% |

*The difference between 100% and the combined indicated percentages represent % ties.

**Builder M is a mixture of carboxymethyltartronate, ditartronate and diglycolate, and is sold under that tradename by Monsanto Chemical Company.

The above procedure is repeated with Composition B of example 1 and the sodium carbonate (Run No. 2 of this example) and sodium metasilicate (Run No. 3 of this example) built compositions with the following results:

| Builder | % Preference Cleanest Panel |
|---|---|
| Composition B vs Sodium Carbonate (Run No. 2) | 59 / 27 |
| Composition B vs Sodium Metasilicate (Run No. 3) | 87 / 13 |

EXAMPLE 6

To test the ability of the polyacrylic resin built composition to clean a more difficult to remove test soil, a synthetic soil described in U.S. Government Federal Specification PD-1747C, and which is generally used to evaluate heavy-duty spray-on wipe-off cleaners, is applied to white linoleum substrates. This soil, which is oily in nature and which contains a high level of finely ground brown pigment, provides a severe staining characteristic that is not easily removed.

Each linoleum test panel is smeared with a small quantity of the synthetic soil, rolling it out with a printer's rubber ink roller until a uniform and smooth coating is obtained. Each linoleum strip was dryed for about a half hour at 90° C. and cooled slowly to room temperature. Five strips were soaked in each of the test compositions H to J tabulated below for 60 seconds, followed by 10 to 20 scrub cycles using a sponge saturated with the respective compositions.

| | % actives by weight | | |
|---|---|---|---|
| | H | I | J |
| Isopropyl alcohol | 4.0 | 4.0 | 4.0 |
| n-Butyl ether ethylene glycol | 2.5 | 2.5 | 2.5 |
| Sodium lauryl sulfate | 0.1 | 0.1 | 0.1 |
| Polyacrylic resin (same as example 1) | 0.2 | 0.2 | 0.2 |
| Fluorocarbon Surfactant (same as example 1) | | 0.02 | 0.06 |
| Ammonium Hydroxide | 0.6 | 0.6 | 0.6 |
| Water (deionized) | qs to 100% | qs to 100% | qs to 100% |

The cleaning efficiency is measured in terms of percent soil removed by averaging the results of the five test strips for each composition. The results are based on average reflectance readings taken from the strips before soiling, after soiling, and after cleaning, three regardings being taken for each strip. The following results are obtained:

| Formulation | % Cleaning Efficiency |
|---|---|
| H | 57; 59%* |
| I | 60% |
| J | 67% |

*Values based on two different trials.

EXAMPLE 7

This example tests the "misuse" wipe-off characteristics of the compositions of this invention. "Misuse" means that the cleaning composition is allowed to remain on the glass or other substrate for a longer than normal time, for example, about 5 minutes, to leave a dry residue of the cleaning composition on th substrate. The easier it is to remove the dry residue, the better the wipe-off characteristics.

It is found that the compositions based on the alkali metal salts, especially the sodium salt, of the polyacrylic resin, have better misuse wipe-off charactertistics than the ammonium salt form. In the composition A used in example 1 some of the ammonia is found to react with the polyacrylic acid to form the ammonium salt thereof, the composition A being difficult to remove in the misuse test. The following composition K containing the composition A resin as the substantially neutralized sodium salt thereof is prepared by first diluting 0.26 gm of the polyacrylic resin used in example 1 (as its 50% aqueous solution) in 999.7 gm distilled water, and then adding 8.3 ml of 0.2N NaOH to raise the pH to 9.5. This solution is then used to prepare the following composition K:

| | % actives by weight K |
|---|---|
| Isopropyl alcohol | 4.0 |
| n-Butyl ether ethylene glycol | 2.5 |
| Sodium lauryl sulfate | 0.1 |
| $NH_4OH$ (26° Baume $NH_3$) | 0.6 |
| Polyacrylic resin, Na Salt, deionized water solution | qs to 100% |
| Dye | 0.00088 |

This composition has a final pH of 11.2.

When this composition is applied (sprayed-on) to a glass panel and allowed to dry, the residue could be removed by washing with water, or with additional composition K, and gentle rubbing. The dried composition A from example 1 required vigorous rubbing for complete removal.

EXAMPLE 8

The following compositions are prepared:

| Ingredient | L | M | N | O | P | Q | R |
|---|---|---|---|---|---|---|---|
| Isopropyl alcohol | 2.76 | 2.76 | 2.76 | 12.0 | 1.0 | 12.0 | 5.23 |
| n-Butyl ether ethylene glycol | 1.73 | 1.73 | 1.73 | 2.5 | 8.0 | 8.0 | 3.27 |
| Polyacrylic resin (from example 1) | 0.04 | 0.03 | 0.05 | 0.005 | 2.0 | 0.2 | 0.02 |
| Fluorocarbon surfactant (from example 1) | 0.02 | 0.02 | 0.02 | 0.02 | 0.5 | 0.06 | 0.02 |
| Nonyl phenoxy-poly-ethoxyethanol (Igepal CO-630) | 0.005 | 0.05 | 0.05 | | | | |
| Ammonium hydroxide | 0.6 | 0.6 | 0.6 | 0.005 | 0.6 | 2.0 | 1.0 |
| Fragrance(s) | 0.04 | 0.04 | 0.04 | | | | |
| Dye(s) | 0.0027 | | | | | | |

-continued

| Ingredient | L | M | N | O | P | Q | R |
|---|---|---|---|---|---|---|---|
| Water (deionized) | qs 100 | qs 100 | qs 100 | qs 100 | qs 100 | qs 100 | qs 100 |

The values above are on an active basis.

EXAMPLE 9

The following composition S illustrates the incorporation of tetrasodium pyrophosphate:

| | % actives by weight |
|---|---|
| Isopropyl alcohol | 4.0 |
| n-Butyl ethylene glycol | 2.5 |
| Sodium lauryl sulfate | 0.1 |
| Polyacrylic resin (from example 1) | 0.005 |
| Tetrasodium pyrophosphate | 0.005 |
| Ammonium hydroxide | 0.60 |
| Deionized water | qs 100% |

EXAMPLE 10

Composition T is prepared with Colloid 119/50 polyacrylic acid, a product of Colloids, Inc. provided as a 50% aqueous solution, this particular resin having a molecular weight of about 1200, a specific gravity of about 1.18 g/ml at 25° C., and a viscosity of about 125 cps at 25° C. (50% aqueous solution). The pH is 2.1.

| | % actives by weight |
|---|---|
| Isopropyl alcohol | 4.00 |
| n-Butyl ethylene glycol | 2.50 |
| Sodium lauryl sulfate | 0.10 |
| Polyacrylic resin (Colloid 119/50) | 0.01 |
| Ammonium hydroxide | 0.60 |
| Dye | 0.001 |
| Fragrance | 0.02 |
| Water | qs 100% |

This composition, when included in the static grease removal test, provided the following results in comparison to an equivalent composition having 0.01% TSPP actives (Composition U):

| Aged Grease Plate (½ day) - Grease Removal Test % Grease Removal | | |
|---|---|---|
| Contact Time | Composition T | Composition U |
| 30 seconds | 90 | 95 |
| 20 | 95 | 93 |
| 10 | 43 | 25 |

What is claimed is:

1. An aqueous composition for cleaning glass and similar hard surfaces comprising an aqueous solution of
   (a) about 0.5–8% of at least one lower aliphatic monohydric alcohol having about 2–4 carbon atoms and a boiling point not in excess of about 100° C.;
   (b) about 0.5–5% of at least one higher boiling polar organic solvent selected from the group consisting of glycols having from 2–6 carbon atoms and 1–4 carbon alkyl ethers of a glycol containing a total of about 3–8 carbon atoms and having a boiling point not in excess of about 250° C.;
   (c) about 0.05–5% of at least one surface active agent compatible with components (a) and (b) and selected from the group consisting of water soluble anionic and non-ionic surface active agents; and
   (d) about 0.005 to 2.0% of a low molecular weight polyacrylic resin comprising polyacrylic acids and the corresponding alkali metal, ammonium and amine salts thereof characterized by the formula

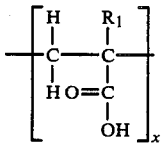

wherein $R_1$ is hydrogen or methyl, and x is a number of from about 10 to about 100, the weight average molecular weight being between about 500 to about 8000; all percentages being by weight, and water being the balance.

2. The composition of claim 1 which further comprises
   (e) about 0.005–0.5% of an anionic fluorocarbon surfactant.

3. The composition of claim 2 wherein said fluorocarbon surfactant is perfluorooxybenzene sulfonic acid salt.

4. The composition of claim 2 wherein said fluorocarbon surfactant is a linear perfluoroalkyl oxybenzoic acid.

5. The composition of any one of claim 1 which further comprises
   (f) about 0.005–2.5% of a fugitive alkaline compound.

6. The composition of claim 1 wherein said polyacrylic resin (d) is further characterized by a viscosity in the range of about 400 to about 850 cps for a 50% by weight in water mixture, a pH of between 1.50 to about 9.00, an acid value of from about 5–20 meq/g, and a molecular weight distribution in which the weight average molecular weight $\overline{M}w$ is about 1,000–5,000, the number average molecular weight $\overline{M}n$ is about 1,200–3,000.

7. The composition of claim 6 further comprising between 0.005 and 0.5% by weight of a second builder selected from the group consisting of tetrasodium pyrophosphate, sodium carbonate, sodium metasilicate, sodium borate, ammonium carbonate, ammonium bicarbonate, sodium citrate, a mixture of carboxymethyl tartronate, ditartronate and diglycolate, and admixtures of same.

8. The composition of claim 5 provided in aerosol form, said aerosol form further comprising an effective amount of a propellant and less than 1.0% by weight of a corrosion inhibitor.

9. The composition of claim 5 further comprising optional adjuvants selected from dyes, fragrances and foaming or anti-fog agents.

10. The composition of claim 5 wherein the surfactant (c) is an alkali salt of an alkyl sulfate of from 8 to 18 carbons.

11. The composition of claim 10 wherein the fugitive alkaline compound is ammonia, the amount thereof being between 0.015 and 0.8% by weight of the composition.

12. A concentrate composition containing no more than 50% actives by weight, which concentrate composition, when diluted with an effective amount of water, provides the glass cleaning composition of claim 1.

13. The concentrate composition of claim 12 wherein the alcohol solvent (a) has a concentration of up to about 30% by weight, the solvent (b) has a concentration up to about 12% by weight, the surfactant concentration is between about 0.5 to about 5.0% by weight, and the polyacrylic resin concentration is less than about 2% by weight.

14. The concentrate composition of claim 13 further comprising a fugitive alkaline compound.

15. The concentrate composition of claim 14 wherein the fugitive alkaline agent is ammonia, and is present in an amount of between 1 to 2.5% by weight.

16. The composition of claim 1 wherein $R_1$ is hydrogen.

17. A method for cleaning glass and similar hard surfaces for removal of fat, grease, or other dirt deposits, which comprises applying to the surface an effective amount of the aqueous composition of claim 1 and thereafter wiping off the aqueous composition with said fat, grease, or other dirt deposit, whereby the removal of the fat, grease, or other dirt deposit is at least as effective as would be obtained with a similar composition containing the equivalent weight of an alkali metal polyphosphate builder in place of the low molecular weight polyacrylic resin (d) present in the aqueous composition.

18. The composition of claim 1 wherein component (d) low molecular weight polyacrylic resin is present in an amount of from about 0.005–0.5%.

19. The composition of claim 1 wherein component (d) low molecular weight polyacrylic resin is present in an amount of from about 0.01 to 0.1%.

20. The composition of claim 2 wherein the component (e) an anionic fluorocarbon surfactant is present in an amount of from about 0.005–0.06%.

21. The composition of claim 5 wherein the fugitive alkaline compound (f) is ammonium hydroxide.

22. The composition of claim 21 wherein the amount of ammonium hydroxide as the fugitive alkaline compound (f) is from about 0.015–0.1%.

23. The composition of claim 1 which contains from about 0.01 to 0.5% by weight of the low molecular weight polyacrylic resin (d) and which further comprises (e) about 0.005–0.06% of an anionic fluorocarbon surfactant.

24. The composition of claim 23 wherein said fluorocarbon surfactant is a perfluorooxybenzene sulfonic acid salt or a linear perfluoroalkyloxybenzoic acid.

25. The aqueous composition of claim 1 comprising an aqueous solution of (a) about 1 to about 5% of said at least one lower aliphatic monohydric alcohol;
(b) about 1 to about 3% of said at least one higher boiling polar organic solvent;
(c) about 0.05 to about 1% of said at least one surface active agent;
(d) about 0.005 to 0.5% of said low molecular weight polyacrylic resin;
(e) up to about 0.06% by weight of an anionic fluorocarbon surfactant; and
(f) up to about 1.0% by weight of a fugitive alkaline compound.

26. An aqueous composition for cleaning glass and similar hard surfaces comprising an aqueous solution of (a) about 0.5–8% of at least one lower aliphatic monohydric alcohol having about 2–4 carbon atoms and a boiling point not in excess of about 100° C.;
(b) about 0.5–5% of at least one higher boiling polar organic solvent selected from the group consisting of glycols having from 2–6 carbon atoms and 1–4 carbon alkyl ethers of a glycol containing a total of about 3–8 carbon atoms and having a boiling point not in excess of about 250° C.;
(c) about 0.5–5% of at least one surface active agent compatible with components (a) and (b) and selected from the group consisting of water soluble anionic and non-ionic surface active agents; and
(d) about 0.005 to 2.0% of a mixture of a low molecular weight polyacrylic resin comprising polyacrylic acids and the corresponding alkali metal, ammonium and amine salts thereof characterized by the formula

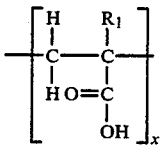

wherein $R_1$ is a hydrogen or methyl, and x is a number of from about 10 to about 100, the weight average molecular weight being between about 500 to about 8000;

with an acrylic polymer complex of the type

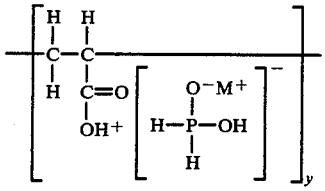

and the corresponding alkali metal, ammonium and amine salts thereof, where $R_1$ is as previously defined, and M's are independently a hydrogen atom or a member selected from the group consisting of alkali metal, ammonium and amino cations, and y is from about 5 to about 60, the ratio of said polyacrylic acid to the acrylic polymeric complex being on a weight basis between about 1:1 to about 15:1; all percentages being by weight, and water being the balance.

27. The composition of claim 26 wherein said polyacrylic resin comprises said polyacrylic acid and said acrylic polymeric complex at a weight ratio of from about 3:1 to about 10:1.

28. The composition of claim 27 wherein the acrylic polymeric complex is a phosphinate containing complex of the formula $$(C_3H_4O_2.H_3O_2P.Na)_y$$

where y is as previously defined.

29. The composition of claim 26 which further comprises (e) about 0.05–0.5% of an anionic fluorocarbon surfactant; and
(f) about 0.005–2.5% of a fugitive alkaline compound.

* * * * *

UNITED STATES PATENT AND TRADEMARK OFFICE

CERTIFICATE OF CORRECTION

PATENT NO. : 4,606,842

DATED : August 19, 1986

INVENTOR(S) : GEORGE B. KEYES, ET AL.

It is certified that error appears in the above-identified patent and that said Letters Patent is hereby corrected as shown below:

ON THE TITLE PAGE

[75] Inventors:

In the name of the second inventor, delete "Lux", insert --Luz--.

IN THE CLAIMS

Claim 7, line 1, (column 16, line 47), delete "claim 6", insert --claim 5--.

Signed and Sealed this

Twenty-eighth Day of October, 1986

[SEAL]

*Attest:*

DONALD J. QUIGG

*Attesting Officer* *Commissioner of Patents and Trademarks*